US011673153B2

(12) United States Patent
Yi

(10) Patent No.: US 11,673,153 B2
(45) Date of Patent: Jun. 13, 2023

(54) TWO-WAY PUMPING DEVICE FOR CONSUMPTION OF RESIDUAL AMOUNT OF LIQUID

(71) Applicants: Eun Suk Yi, Gyeonggi-do (KR); JARAM CO., LTD., Gyeonggi-do (KR)

(72) Inventor: Eun Suk Yi, Gyeonggi-do (KR)

(73) Assignees: Eun Suk Yi, Gyeonggi-do (KR); JARAM CO., LTD., Gyeonggi-do (KR)

( * ) Notice: Subject to any disclaimer, the term of this patent is extended or adjusted under 35 U.S.C. 154(b) by 0 days.

(21) Appl. No.: 17/427,666

(22) PCT Filed: Feb. 12, 2020

(86) PCT No.: PCT/KR2020/001971
§ 371 (c)(1),
(2) Date: Aug. 2, 2021

(87) PCT Pub. No.: WO2021/015380
PCT Pub. Date: Jan. 28, 2021

(65) Prior Publication Data

US 2022/0134368 A1 May 5, 2022

(30) Foreign Application Priority Data

Jul. 19, 2019 (KR) ..... 10-2019-0087756
Feb. 4, 2020 (KR) ..... 10-2020-0013318

(51) Int. Cl.
*B05B 11/00* (2023.01)
*B05B 11/10* (2023.01)

(52) U.S. Cl.
CPC ..... *B05B 11/1042* (2023.01); *B05B 11/1002* (2023.01)

(58) Field of Classification Search
CPC ... B05B 11/3042; B05B 11/3002; B05B 1/14; B05B 11/0044; B05B 11/0059;
(Continued)

(56) References Cited

U.S. PATENT DOCUMENTS 3,627,206 A * 12/1971 Boris ..... B05B 11/3023 222/321.9
3,923,250 A * 12/1975 Boris ..... B05B 11/3016 222/321.2
(Continued)

FOREIGN PATENT DOCUMENTS

AR 035172 5/2004
CN 201579156 9/2010
(Continued)

OTHER PUBLICATIONS

JP2002347866 with Machine Translation (Year: 2002).*
(Continued)

*Primary Examiner* — Vishal Pancholi
(74) *Attorney, Agent, or Firm* — JCIPRNET

(57) ABSTRACT

The present disclosure relates to a two-way pumping device for consumption of a residual amount of a liquid. The two-way pumping device includes a vessel, a body portion including first and second chambers for storing a liquid, a suction pipe extending to the outside of the body portion, a first bearing for opening and closing the suction pipe, a pump portion including a head portion protruding outside the body portion, a first piston slidably moving in the first chamber, a second piston slidably moving in the second chamber, a first discharge portion that discharges a fluid in the first chamber to the outside, a second discharge portion that discharges a fluid in the second chamber to the outside, a spring that applies an elastic restoring force to the pump
(Continued)

portion, and a suction portion capable of causing a liquid to flow into the second chamber.

5 Claims, 11 Drawing Sheets

(58) Field of Classification Search
CPC ..... B05B 11/3023; B05B 11/3067; B05B 11/3047; B05B 11/0037; B05B 11/042
See application file for complete search history.

(56) References Cited

U.S. PATENT DOCUMENTS

| | | | | |
|---|---|---|---|---|
| 4,174,790 | A | 11/1979 | Nozawa et al. | |
| 4,305,530 | A | 12/1981 | Nozawa | |
| 5,115,980 | A | 5/1992 | Skorka | |
| 5,217,148 | A * | 6/1993 | Cater | B05B 11/3039 222/321.2 |
| 6,036,113 | A | 3/2000 | D'Angelo | |
| 6,220,483 | B1 | 4/2001 | van der Heijden | |
| 8,439,234 | B2 | 5/2013 | Chen | |
| 2002/0000452 | A1 * | 1/2002 | Iizuka | B05B 7/0037 222/190 |
| 2008/0169311 | A1 * | 7/2008 | Van Der Heijden | B05B 7/0037 222/190 |

FOREIGN PATENT DOCUMENTS

| | | |
|---|---|---|
| CN | 201579158 | 9/2010 |
| CN | 107654349 | 2/2018 |
| EP | 1433535 | 6/2004 |
| JP | S5437516 | 3/1979 |
| JP | S61241467 | 10/1986 |
| JP | 2002-347866 | 12/2002 |
| JP | 2007152276 | 6/2007 |
| JP | 2009143617 | 7/2009 |
| KR | 10-0370812 | 2/2003 |
| KR | 10-2008-0012906 | 2/2008 |
| KR | 10-2008-0057451 | 6/2008 |

OTHER PUBLICATIONS

KR20080057451 with Machine Translation (Year: 2008).*
"International Search Report (Form PCT/ISA/210) of PCT/KR2020/001971", with English translation thereof, dated Jun. 12, 2020, pp. 1-6.
"Office Action of Korea Counterpart application", dated Jun. 9, 2020, with English translation thereof, pp. 1-11.
"Notice of Grant of Patent of Korea Counterpart application", dated Oct. 23, 2020, with English translation thereof, pp. 1-4.
"Office Action of China Counterpart Application" with English translation thereof, dated May 25, 2022, p. 1-p. 14.
"Search Report of Europe Counterpart Application", dated Aug. 29, 2022, p. 1-p. 9.
"Notice of Reasons for Refusal of Japan Counterpart Application", dated Aug. 23, 2022, with English translation thereof, p. 1-p. 10.

* cited by examiner

TWO-WAY PUMPING DEVICE FOR CONSUMPTION OF RESIDUAL AMOUNT OF LIQUID

BACKGROUND

Technical Field

The present disclosure relates to a two-way pumping device for consumption of the residual amount of a liquid, and more particularly, to a two-way pumping device for consumption of the residual amount of a liquid, wherein the residual amount of a liquid may be fully consumed by discharging the liquid out of a vessel for storing the liquid when the vessel is arranged in the forward direction and when the vessel is arranged in the reverse direction.

Description of Related Art

In general, a fluid with a certain viscosity, such as shampoo, conditioner, body washing detergent, dish detergent, or cosmetics, is stored in a liquid vessel to be discharged to a user. The liquid vessel is used by opening and closing a lid included therein, and a liquid vessel that discharges a liquid stored therein to an outside by using a screw pumping device has been used.

Liquid vessels using screw pumping devices have different discharge pressures to discharge liquids from the vessels to the outside because the liquids have different viscosities depending on their types, and thus, the amount of liquid which is discharged at one time also varies depending on products. In addition, liquid vessels have different heights and capacities depending on products, and most pumping devices are disposable.

Liquid vessels using pumping devices of the related art have different lengths of suction hoses depending on heights, and in order to discharge a liquid stored in the liquid vessel as easily as possible, the liquid is not in close contact with a bottom of the liquid vessel and is at a small distance from the bottom, and an end of the suction hose is installed diagonally.

However, a liquid vessel using a pumping device of the related art has the following problems. As described above, the suction hose is spaced apart from the bottom of the vessel without being in close contact with the bottom of the liquid vessel to easily discharge the liquid stored in the liquid vessel. Due to this, there is a problem in that a liquid stored in a liquid vessel may not be totally discharged through the pumping device of the related art.

Because the residual amount of the liquid on the bottom of the liquid vessel is quite large, discarding the residual amount of the liquid without using it is uneconomical. In addition, there is a problem in that, when the residual amount of the liquid in the liquid vessel is discharged without being used, environmental pollution occurs due to the residual amount of the liquid.

In order to use the residual amount of the liquid in the liquid vessel, the liquid vessel may be used by being turned upside down and opening a lid thereof, and in this case, the liquid is concentrated in an opening portion of the lid, and thus, much more liquid than necessary may be poured out at once.

In addition, in order to use the residual amount of the liquid stored in the liquid vessel, water may also be added inside of the liquid vessel and the liquid vessel is shaken for use, but in this case, there is a problem in that bacterial growth, bacterial infection, and so on may occur in the liquid vessel in a short time, thereby adversely affecting a user.

SUMMARY

Technical Problem

The present disclosure solves the above-described problems, and more particularly, relates to a two-way pumping device for consumption of the residual amount of a liquid, wherein the residual amount of a liquid may be fully consumed by discharging the liquid out of a vessel for storing the liquid when the vessel is arranged in the forward direction and when the vessel is arranged in the reverse direction.

Solution to Problem

In order to solve the above-described problems, a two-way pumping device for consumption of a residual amount of a liquid according to the present disclosure includes a vessel having an inner space for storing a liquid and a coupling hole for communicating with the inner space; a body portion coupled to the coupling hole and including a first chamber and a second chamber for storing the liquid; a suction pipe for communicating with the first chamber and extending to an outside of the body portion; a first bearing provided between the first chamber and the suction pipe to open and close the suction pipe; a pump portion slidably coupled to the body portion and including a head portion protruding outside the body portion; a first piston coupled to the pump portion to slidably move together with the pump portion and configured to slidably move in the first chamber; a second piston coupled to the pump portion to slidably move together with the pump portion and configured to slidably move in the second chamber; a spring provided in a lower portion of the pump portion to apply an elastic restoring force to the pump portion; and a suction portion for causing the liquid to flow into the second chamber.

In order to solve the above-described problems, the two-way pumping device for consumption of the residual amount of liquid according to the present disclosure may further include a first discharge portion provided in the head portion of the pump portion to communicate with the first chamber to discharge a fluid in the first chamber to the outside; and a second discharge portion provided in the head portion of the pump portion to communicate with the second chamber to discharge a fluid in the second chamber to the outside, wherein, when the vessel is arranged in a forward direction, the fluid in the first chamber may be discharged through the first discharge portion, and when the vessel is arranged in a reverse direction, the fluid in the second chamber may be discharged through the second discharge portion.

In order to solve the above-described problems, the two-way pumping device for consumption of the residual amount of liquid according to the present disclosure may further include a first movement flow path provided in the pump portion and connecting the first chamber to the first discharge portion, and a second movement flow path provided in the pump portion and connecting the second chamber to the second discharge portion.

In order to solve the above-described problems, in the two-way pumping device for consumption of the residual amount of liquid according to the present disclosure, a connection flow path through which the suction portion communicates with the inner space may be provided in an upper surface of the inner space of the vessel.

In order to solve the above-described problems, in the two-way pumping device for consumption of the residual amount of liquid according to the present disclosure, a second bearing for opening and closing the second chamber may be provided between the suction portion and the second chamber, and the second bearing may close a space between the suction portion and the second chamber when the pump portion descends and may open the space between the suction portion and the second chamber when the pump portion ascends.

In order to solve the above-described problems, in the two-way pumping device for consumption of the residual amount of liquid according to the present disclosure, the body portion may include a partition portion that partitions the body portion into the first chamber and the second chamber.

In order to solve the above-described problems, in the two-way pumping device for consumption of the residual amount of liquid according to the present disclosure, the pump portion may include a first pump portion coupled to the first piston, and a second pump portion coupled to the second piston, and the first pump portion and the second pump portion may be connected to each other through a connection portion.

In order to solve the above-described problems, in the two-way pumping device for consumption of the residual amount of liquid according to the present disclosure, an air discharge hole may be provided in an upper portion of the first chamber.

Advantageous Effects of Disclosure

The present disclosure relates to a two-way pumping device for consumption of the residual amount of liquid, the two-way pumping device may discharge a liquid out of a vessel for storing the liquid when the vessel is arranged in the forward direction and when the vessel is arranged in the reverse direction, and thus, there is an advantage in that the residual amount of liquid may be fully consumed.

In addition, the present disclosure fully consumes the residual amount of liquid, and thus, there is an advantage in that the liquid may be used economically, and there is an effect that environmental pollution may be prevented from occurring because the residual amount of liquid is prevented from being wasted.

DESCRIPTION OF THE EMBODIMENTS

The present specification clarifies a scope of the present disclosure, describes principles of the present disclosure, and discloses embodiments such that those skilled in the art to which the present disclosure pertains may practice the present disclosure. The disclosed embodiments may be implemented in various forms.

Expressions such as "include" or "may include" that may be used in various embodiments of the present disclosure indicate presence of corresponding disclosed function, operation, component, or so on, and do not limit one or more additional functions, operations, components, or so on. In addition, it should be understood that, in various embodiments of the present disclosure, terms such as "include" or "have" are intended to designate that feature, number, step, operation, configuration element, component, or combination thereof described in the specification are present, and possibility of addition or presence of one or more other features, numbers, steps, operations, configuration elements, components, or combinations thereof is not precluded.

It should be understood that, when a configuration element is referred to as being "connected" or "coupled" to the other configuration element, the configuration element may be directly connected or coupled to the other configuration element, and there may be another new configuration element between the configuration element and the other configuration element. In addition, it should be understood that, when a configuration element is "directly connected" or "directly coupled" to another configuration element, there is no new configuration element between the configuration element and another configuration element.

The terms such as first and second used in the present specification may be used to describe various configuration elements, but the configuration elements should not be limited to the terms. Terms are used only for the purpose of distinguishing one configuration element from another configuration element.

The present disclosure relates to a two-way pumping device for consumption of the residual amount of a liquid, and relates to a two-way pumping device for consumption of the residual amount of a liquid, wherein the residual amount of a liquid may be fully consumed by discharging the liquid out of a vessel for storing the liquid when the vessel is arranged in the forward direction and when the vessel is arranged in the reverse direction. Hereinafter, preferred embodiments of the present disclosure will be described in detail with reference to the accompanying drawings.

Figure 1:
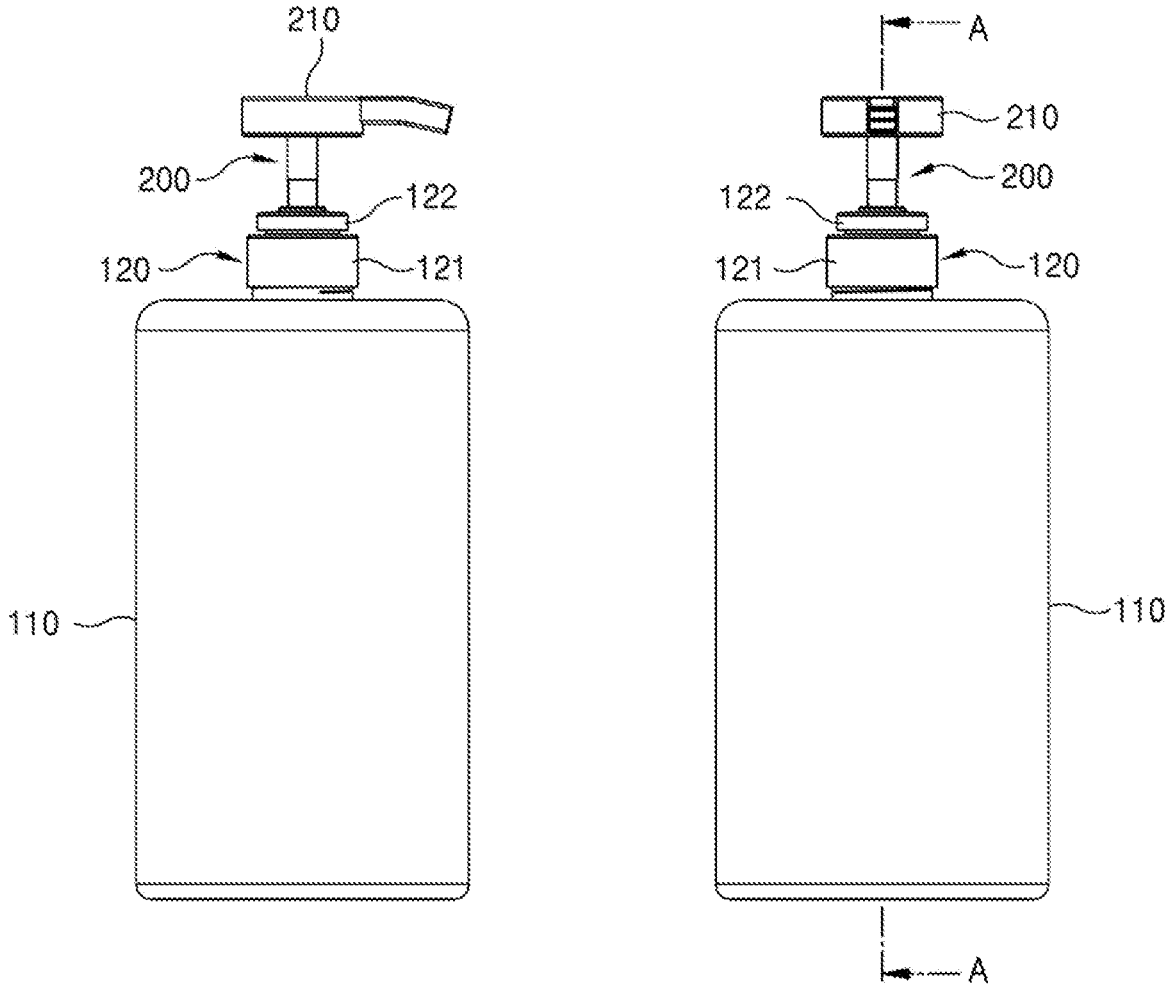
FIG. 1 Illustrates a side view and a front view of a two-way pumping device for consumption of a residual amount of a liquid according to an embodiment of the present disclosure.

In the following description, arranging a vessel 110 in a forward direction indicates that the vessel 110 is erected as illustrated in FIG. 1, and arranging the vessel 110 arranged in a reverse direction indicates that the vessel 110 is upside down as illustrated in FIG. 8 to FIG. 11.

Figure 2:
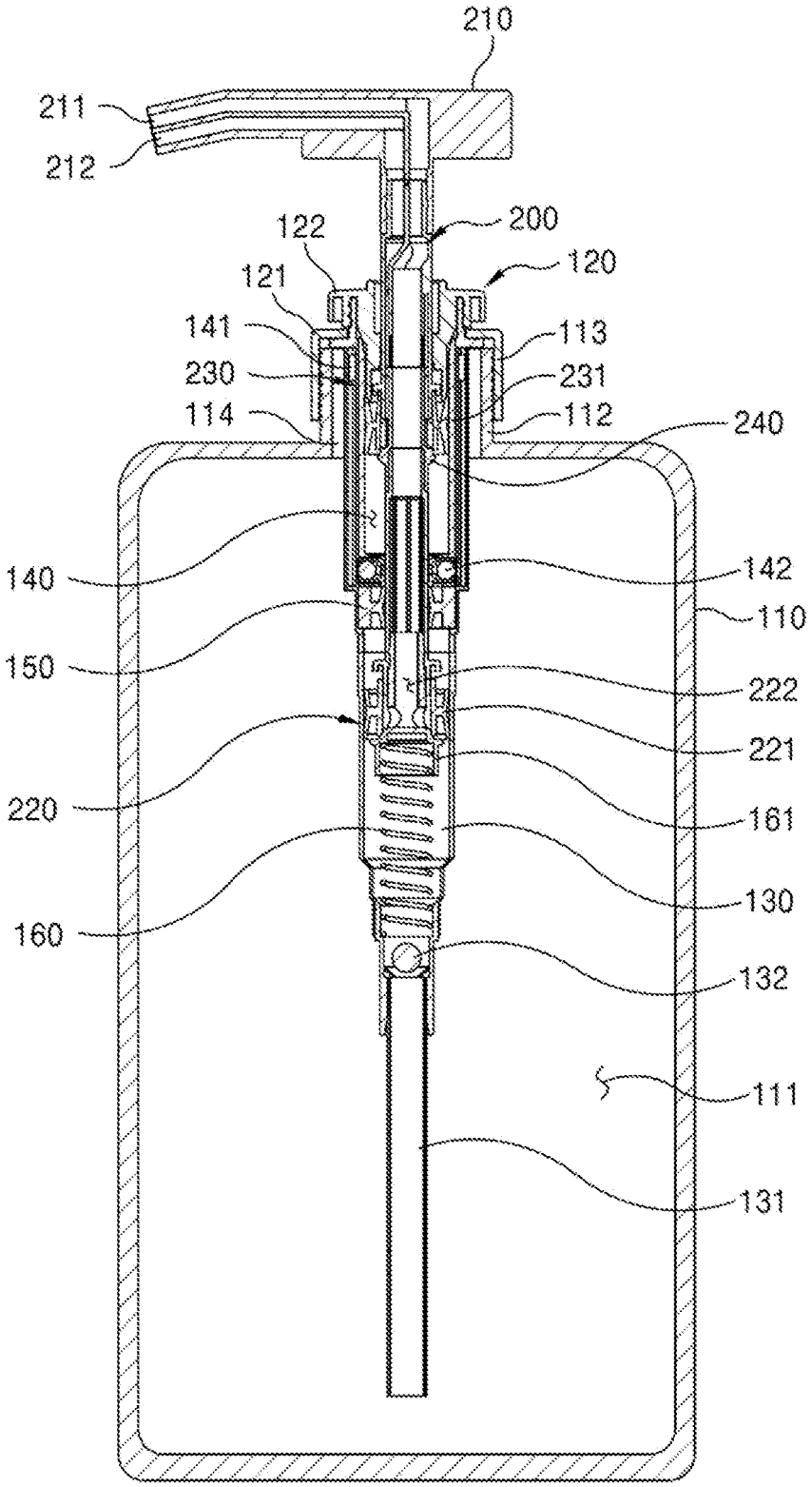
FIG. 2 is a cross-sectional view taken along line A-A of FIG. 1.

Referring to FIG. 1 and FIG. 2, a two-way pumping device for consumption of the remaining amount of liquid according to an embodiment of the present disclosure includes the vessel 110, a body portion 120 including a first chamber 130 and a second chamber 140, a suction pipe 131, a first bearing 132, a pump portion 200, a first piston 221, a second piston 231, a first discharge portion 211, a second discharge portion 212, a spring 160, and a suction portion 141.

Referring to FIG. 2, the vessel 110 may include an inner space 111 in which a liquid may be stored, and a coupling hole 112 communicating with the inner space 111. The coupling hole 112 may be open toward the outside, and the body portion 120 to be described below is coupled to the coupling hole 112.

The vessel 110 may store a liquid, and the vessel 110 may have various shapes as long as the vessel 110 may store a liquid and may be made of a material such as a soft material, a hard material, glass. The liquid to be stored in the vessel 110 may be shampoo, conditioner, body wash, kitchen detergent, cosmetics, and so on, and the liquid may be various liquids as long as the liquid may be discharged to the outside through a two-way pumping device while being stored in the vessel 110.

Figure 3:
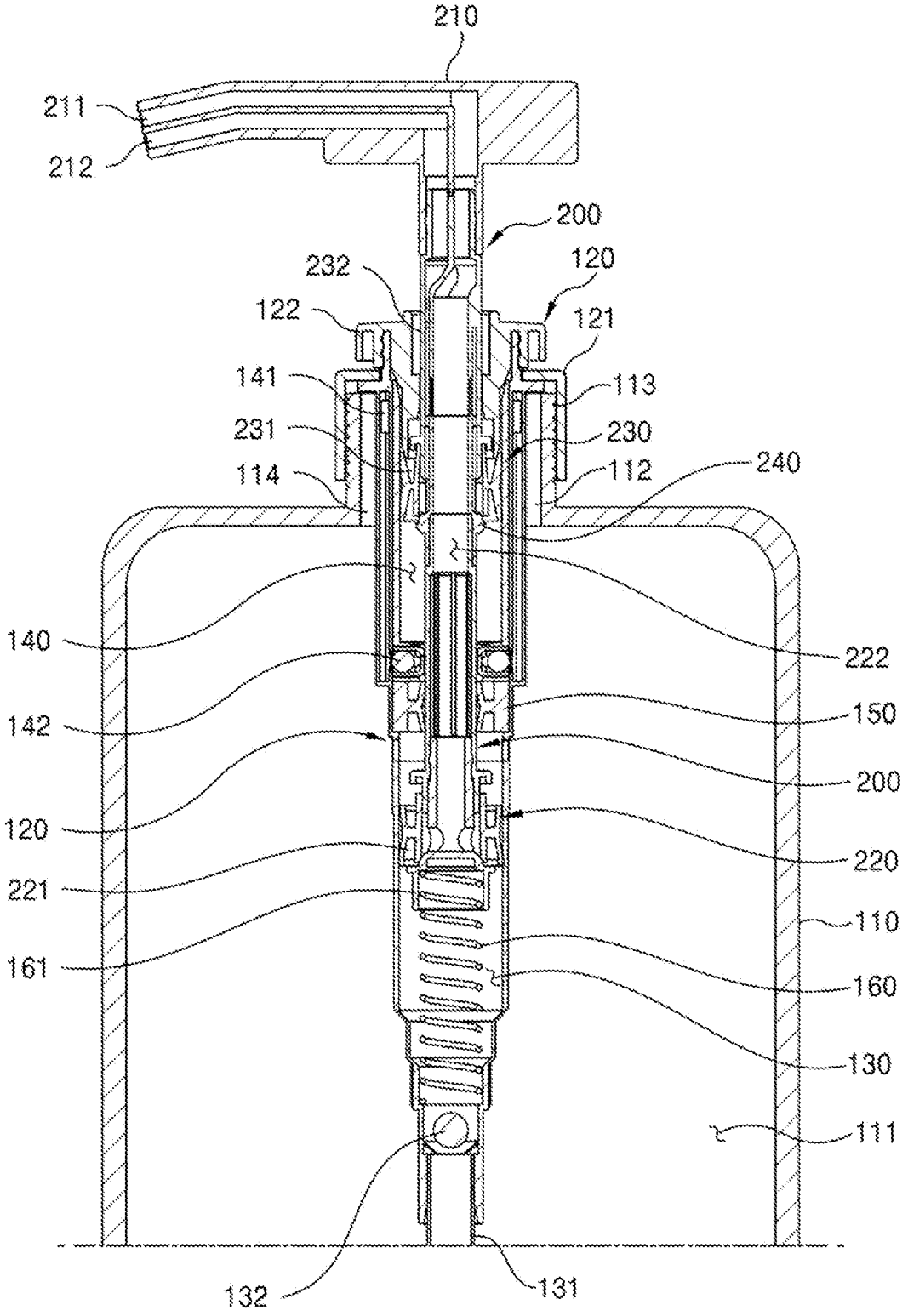
FIG. 3 is a partial enlarged view of FIG. 2.

Referring to FIG. 3, the body portion 120 may include the first chamber 130 and the second chamber 140 in which a liquid may be stored, and the body portion 120 may be coupled to the coupling hole 112.

The body portion 120 may include the first chamber 130 into which a liquid flows when the vessel 110 is arranged in the forward direction, and the second chamber 130 into which a liquid flows when the vessel 110 is arranged in the reverse direction, and the first chamber 130 and the second chamber 140 may be separated from each other by a partition portion 150.

That is, the first chamber 130 and the second chamber 140 may be spaces separated from each other by the partition portion 150 in the body portion 120. The partition portion 150 preferably partitions the first chamber 130 and the second chamber 140 such that air does not flow from the first chamber 130 to the second chamber 140.

The body portion 120 may be formed in a shape of a housing extending in a longitudinal direction, and after the middle portion and a lower portion of the body portion 120 are inserted into an inner space of the vessel 110, an upper portion of the body portion 120 is coupled to the coupling hole 112.

In order to couple the body portion 120 to the coupling hole 112, a lid portion 121 may be provided in the upper portion of the body portion 120. When the lid portion 121 is coupled to the outside of the coupling hole 112 after the middle portion and the lower portion of the body portion 120 pass through the coupling hole 112 to be inserted into the inner space of the vessel 110, the body portion 120 may be fixed to the vessel 110.

A screw thread or a screw groove may be formed in the lid portion 121, and a screw thread 113 or a screw groove may be formed outside the coupling hole 112 of the vessel 110. As the lid portion 121 and the outside of the coupling hole 112 are screwed together, the body portion 120 may be fixed to the vessel 110.

However, coupling between the body portion 120 and the vessel 110 is not limited to the screw coupling, and as long as the upper portion of the body portion 120 may be coupled to the coupling hole 112 of the vessel 110, various configurations may be used.

A stopper portion 122 may be provided on an upper portion of the lid portion 121, and the stopper portion 122 is for supporting the pump portion 200 which will be described below. The pump portion 200 may slide up and down in the body portion 120, and the stopper 122 may support the pump portion 200 so as not to be shaken when the pump portion 200 slides up and down.

Figure 4:
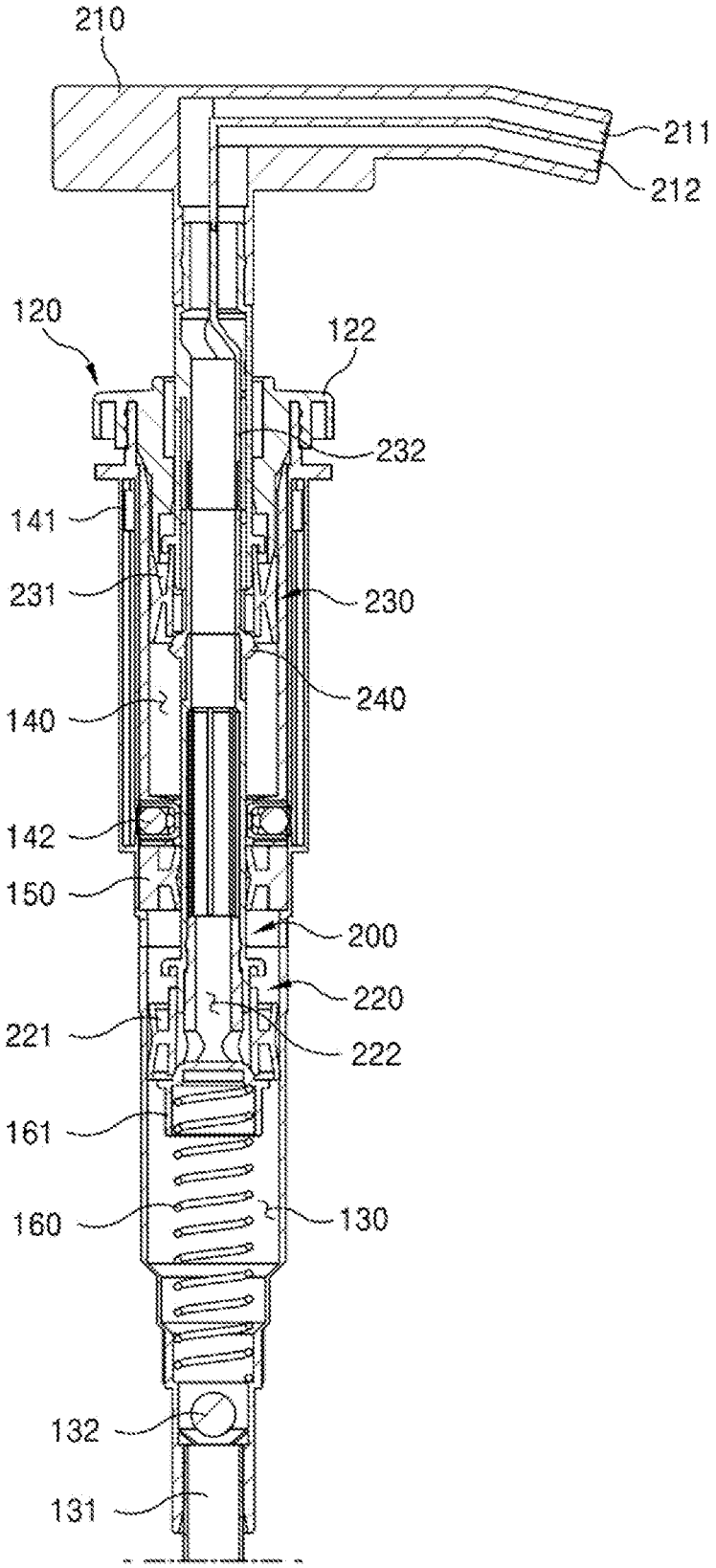
FIG. 4 is a cross-sectional view of a body portion and a pump portion separated from a vessel, according to an embodiment of the present disclosure.
Figure 5:
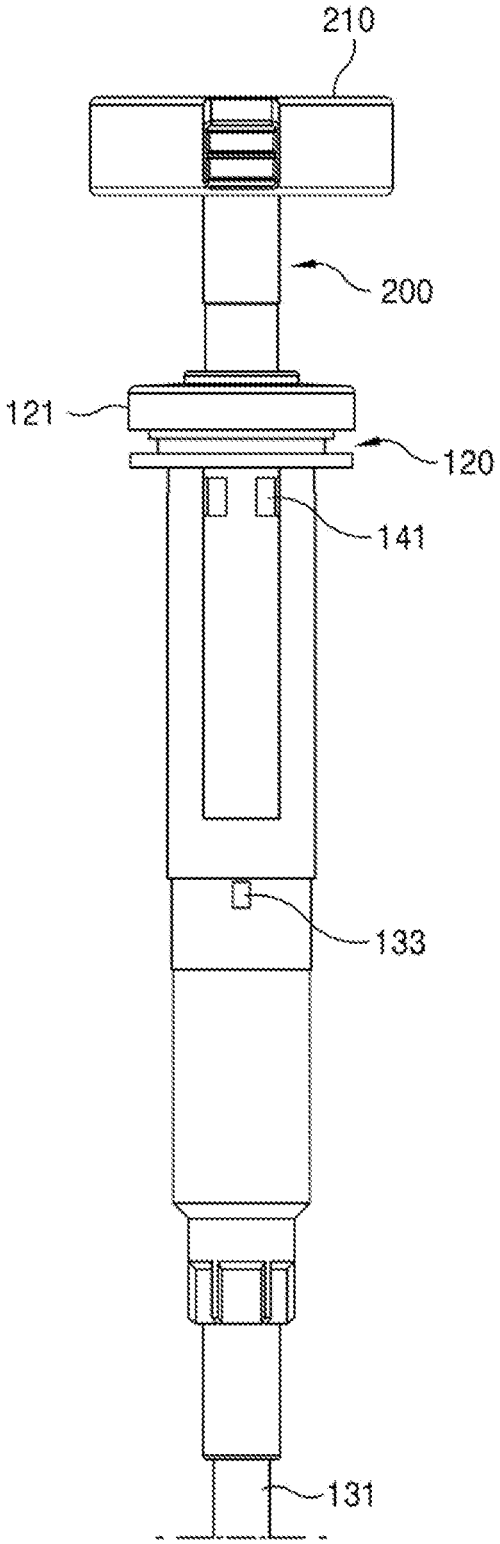
FIG. 5 is a view illustrating the body portion and the pump portion separated from the vessel according to an embodiment of the present disclosure.

Referring to FIG. 4 and FIG. 5, the body portion 120 may extend in the longitudinal direction, and the first chamber 130 may be arranged in a lower direction of the second chamber 140. Here, the lower direction may indicate a lower direction toward the bottom of the vessel 110.

The suction pipe 131 communicates with the first chamber 130 and extends to the outside of the body portion 120. The suction pipe 131 is used when the vessel 110 is arranged in the forward direction, and the suction pipe 131 may extend from the body portion 120 to a lower direction of the vessel 110. When the vessel 110 is arranged in the forward direction, a liquid stored in the vessel 110 moves to the first chamber 130 through the suction pipe 131.

Referring to FIG. 4, the first bearing 132 is provided between the first chamber 130 and the suction pipe 131 to open and close the suction pipe 131. The first bearing 132 may have a bead shape and may be arranged in an inlet of the suction pipe 131 to open and close the suction pipe 131 according to a pressure of the first chamber 130.

Referring to FIG. 2 to FIG. 4, the pump portion 200 is slidably coupled to the body portion 120 and includes a head portion 210 protruding to the outside of the body portion 120. The head portion 210 is a point at which a force is provided to allow the pump portion 200 to slide, and a user may slide the pump portion 200 downward by pressing the head portion 210.

The spring 160 is provided in a lower portion of the pump portion 200 and may apply an elastic restoring force to the pump portion 200. The spring 160 may be arranged in the body portion 120 to be supported by a stopper 161.

When a user presses the head portion 210 to slide the pump portion 200 downward, the spring 160 is compressed to apply the elastic restoring force to the pump portion 200, and when the user releases the pressing, the pump portion 200 slides upward again due to the elastic restoring force of the spring 160.

Figure 6:
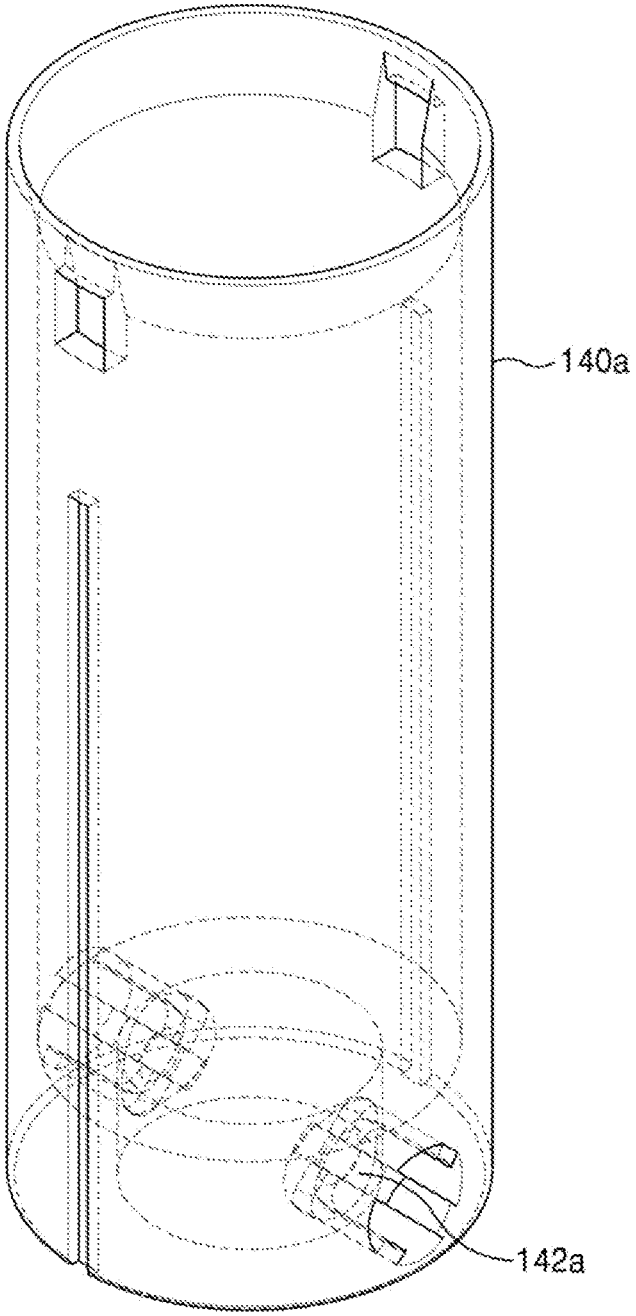
FIG. 6 is a view illustrating the pump portion according to an embodiment of the present disclosure.

Referring to FIG. 6, the pump portion 200 includes the second piston 231 that is coupled to the pump portion 200 to be capable of slidably moving together with the pump portion 200 and is coupled to the first piston 221, which slides in the first chamber 130, and the pump portion 200 to be capable of slidably moving together with the pump portion 200 and slidably moves in the second chamber 140.

The first piston 221 has a lower cross-sectional area equal to a cross-sectional area of the first chamber 130 and slidably moves in the first chamber 130, and the first piston 221 may release or compress an inner space of the first chamber 130 while sliding up and down in the first chamber 130.

The second piston 231 has a lower cross-sectional area equal to a cross-sectional area of the second chamber 140 and slidably moves in the second chamber 140, and the first piston 221 may release or compress an inner space of the second chamber 140 while sliding up and down in the second chamber 140.

The pump portion 200 may include a first pump portion 220 to which the first piston 221 is coupled and a second pump portion 230 to which the second piston 231 is coupled, and the first pump portion 220 and the second pump portion 230 may be connected to each other through a connection portion 240.

The first pump portion 220 and the second pump portion 230 may be connected to each other through the connection portion 240 after being separately assembled, and the first pump portion 220 and the second pump portion 230 may be assembled after being separately manufactured, and thus, there is an advantage in that convenience of manufacturing may be increased.

However, the present disclosure is not limited thereto, and the first pump portion 220 and the second pump portion 230 may be integrally manufactured.

The head portion 210 of the pump portion 200 may include the first discharge portion 211 that communicates with the first chamber 130 and discharges a fluid of the first chamber 130 to the outside, and the second discharge portion 212 that communicates with the second chamber 140 and discharges a fluid of the second chamber 140 to the outside.

The first discharge portion 211 and the second discharge portion 212 may be provided in the head portion 210 and serve as passages through which the fluid may be discharged to the outside. The inside of the pump portion 200 may include a first movement flow path 222 that connects the first chamber 130 to the first discharge portion 211, and a second movement flow path 232 that connects the second chamber 140 to the second discharge portion the 212.

The first movement flow path 222 is a fluid passage connected between the first chamber 130 and the first discharge portion 211, and the second movement flow path 232 is a fluid passage connected between the second chamber 140 and the second discharge portion 212.

The body portion 120 may be provided with the suction portion 141 for a liquid to flow into the second chamber 140. The suction portion 141 communicates with the inner space 111 of the vessel 110, and a liquid stored in the inner space 111 of the vessel 110 may flow into the second chamber 140 through the suction portion 141.

The suction portion 141 is used when the vessel 110 is arranged in the reverse direction, and the suction portion 141 may be arranged in the upper portion of the vessel 110. When the vessel 110 is arranged in the reverse direction, a liquid (residual amount of a liquid) of the vessel 110 is collected in the upper portion of the vessel 110 (here, the upper portion of the vessel 110 refers to an upper portion when the vessel 110 is arranged in the forward direction).

The suction portion 141 may become an inlet for moving the residual amount of the liquid to the second chamber 140 to consume the residual amount of the liquid, and for this purpose, the suction portion 141 is preferably arranged in the upper portion of the vessel 110.

Referring to FIG. 3, a connection flow path 114 for connecting the suction portion 141 to the inner space 111 may also be provided on an upper surface of the inner space 111 of the vessel 110 (here, the upper surface of the inner space 110 of the vessel 110 refers to an upper surface of the inner space 110 when the vessel 110 is arranged in the forward direction).

The connection flow path 114 connects the suction portion 141 to the inner space 111, and a liquid in the inner space 111 flows into the suction portion 141 through the connection flow path 114.

In the two-way pumping device for consumption of the residual amount of a liquid according to an embodiment of the present disclosure, when the vessel 110 is arranged in the forward direction, a fluid in the first chamber 130 may be discharged to the first discharge portion 211, and when the vessel 110 is arranged in the reverse direction, a fluid in the second chamber 140 may be discharged to the second discharge portion 212.

Specifically, when the vessel 110 is arranged in the forward direction, a liquid stored in the inner space 111 of the vessel 110 may be discharged by moving in the order of the suction pipe 131-the first chamber 130-the first movement flow path 222-the first discharge portion 211.

When the vessel 110 is arranged in the reverse direction, the liquid stored in the inner space 111 of the vessel 110 may be collected in the upper portion of the vessel 110 due to gravity, and the liquid collected in the upper portion of the vessel 110 may be discharged by moving in the order of the connection flow path 114-the suction portion 141-the second chamber 140-the second movement flow path 232-the second discharge portion 212 which are provided over an upper surface of the vessel 110.

A second bearing 142 for opening and closing the second chamber 140 may be provided between the suction portion 141 and the second chamber 140. The second bearing 142 may be provided between the second chamber 140 and the suction portion 141 to open and close the second chamber 140.

Figure 7:
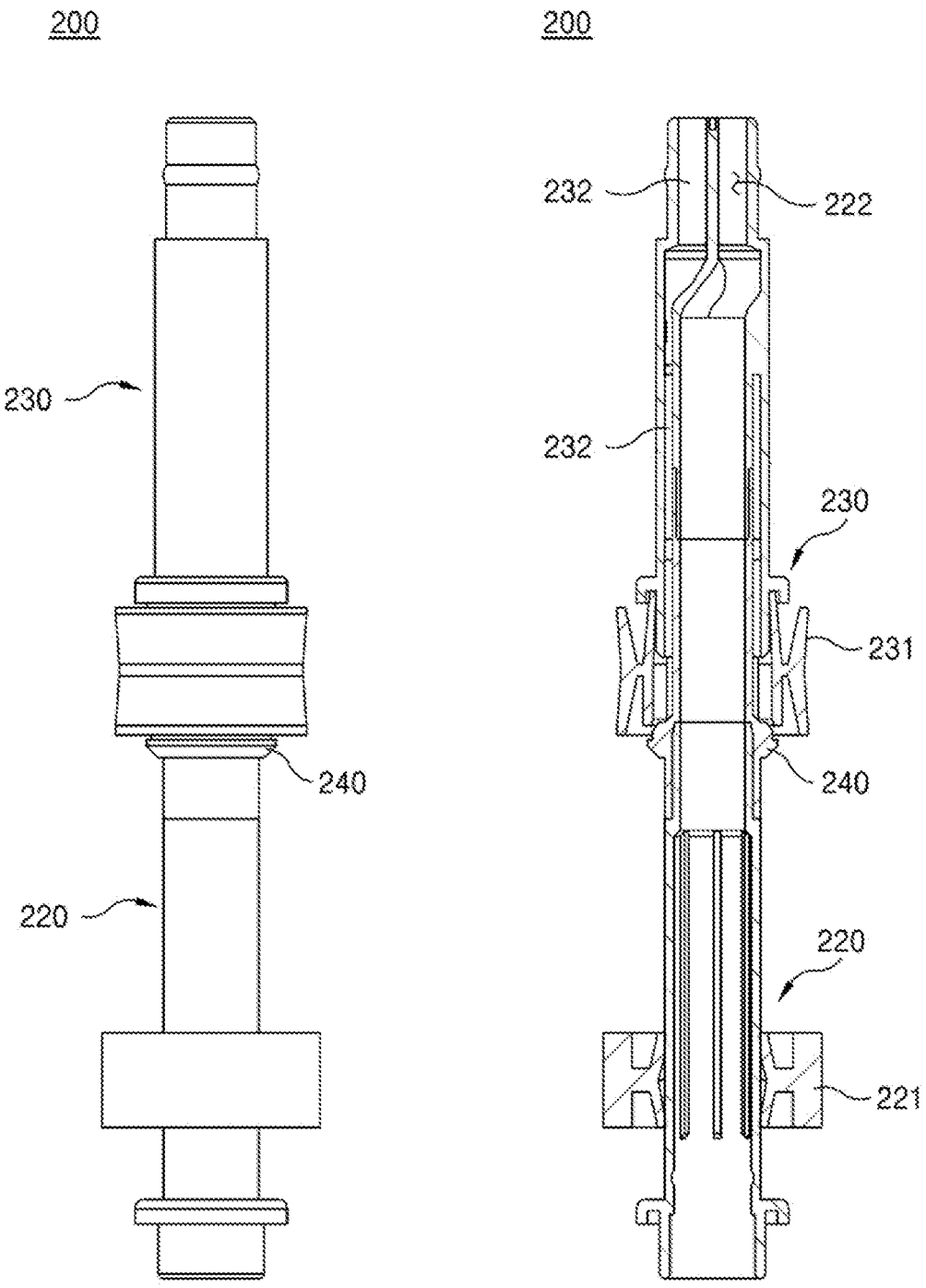
FIG. 7 illustrates views of an outer wall of a second chamber and a through-hole for installing a second bearing according to an embodiment of the present disclosure.

Referring to FIG. 4 and FIG. 7, the second bearing 142 may have a bead shape and may be arranged in an inlet of the second chamber 140. A second chamber outer wall 140*a* forming the second chamber 140 is provided in the body portion 120, and a through-hole 142*a* in which the second bearing 142 having a bead shape may be installed is provided in an inlet of the second chamber outer wall 140*a*. The second bearing 142 may be installed in the through-hole 142*a* to open and close the second chamber 140 according to a pressure of the second chamber 140.

As described above, in the two-way pumping device for consumption of the residual amount of a liquid according to the embodiment of the present disclosure moves the liquid in the vessel 110 in the order of the suction pipe 131-the first chamber 130-the first movement flow path 222-the first discharge portion 211 to discharge the liquid when the vessel 110 is arranged in the forward direction, and moves the liquid in the vessel 110 in the order of the connection flow path 114-the suction portion 141-the second chamber 140-the second movement flow path 232-the second discharge portion 212 to discharge the liquid when the vessel 110 is arranged in the reverse direction.

Hereinafter, a method of operating the two-way pumping device for consumption of the residual amount of the liquid according to the embodiment of the present disclosure described above will be described in detail.

A process in which a liquid of the vessel 110 is discharged through the first discharge portion 211 when the vessel 110 is arranged in the forward direction will be described as follows. When a user applies a force to the head portion 210, the pump portion 200 is pressed.

As the pump portion 200 is pressed, the first piston 221 coupled to the pump portion 200 slides to a lower portion of the first chamber 130 to compress the first chamber 130. At this time, the first bearing 132 is pushed to the outside by the generated compressive force while a space of the first chamber 130 is compressed and blocks an inlet of the suction pipe 131 (the first bearing 132 has a bead shape having a larger diameter than a diameter of an inlet of the suction pipe 131 and may block the suction pipe 131 without being inserted into the suction pipe 131).

When the user removes the force pressing the head portion 210, the pump portion 200 slides upward due to an elastic restoring force of the spring 160 provided in the lower portion of the pump portion 200, and the first piston 221 coupled to the pump portion 200 may also slide upward.

As the first piston 221 slides upward, the space of the first chamber 130 is released, the first bearing 132 is lifted, and a liquid stored in the inner space 111 of the vessel 110 flows into the first chamber 130 through the suction pipe 131.

When a user applies a force to the head portion 210 again, the pump portion 200 is pressed, and the first piston 221 coupled to the pump portion 200 slides toward the lower portion of the first chamber 130, and thus, the first chamber 130 is compressed (at this time, the first bearing 132 blocks the suction pipe 131 again).

As the first chamber 130 is compressed, the liquid flowing into the first chamber 130 also receives a compressive force and moves to the first movement flow path 222, and the liquid moved to the first movement flow path 222 is discharged to the outside through the first discharge portion 211. When the user removes the force pressing the head portion 210, the liquid in the vessel 110 flows into the first chamber 130 while the above-described processes are repeated.

A process in which the liquid of the vessel 110 is discharged through the second discharge portion 212 when the vessel 110 is arranged in the reverse direction will be described below. A case in which the vessel 110 is arranged in the reverse direction is a case in which the residual amount of the liquid in the vessel 110 is no longer discharged while the vessel 110 is arranged in the forward direction.

Because the liquid may be no longer discharged in the order of the suction pipe 131-the first chamber 130-the first movement flow path 222-the first discharge portion 211, the user arranges the vessel 110 in the reverse direction to use the residual amount of the liquid. When the vessel 110 is arranged in the reverse direction, the liquid in the vessel 110 is collected in the upper portion of the vessel 110 due to gravity. In order to use the residual amount of the liquid, the user applies a force to the head portion 210 after the vessel 110 is arranged in the reverse direction.

When a user applies a force to the head portion 210, the pump portion 200 is pressed. As the pump portion 200 is pressed, the second piston 231 coupled to the pump portion 200 slides to a lower portion of the second chamber 140 to compress the second chamber 140 (the upper portion refers to an upward direction when the vessel 110 is arranged in the forward direction, and the lower portion refers to a downward direction when the vessel 110 is arranged in the forward direction).

At this time, the second bearing 142 is pushed to the outside by the generated compressive force while a space of the second chamber 140 is compressed and blocks an inlet of the second chamber 140 (the second bearing 142 has a bead shape having a larger diameter than a diameter of the through-hole 142*a* which is the inlet of the second chamber 140 and may block the second chamber 140 without being inserted into the suction portion 141).

Figure 8:
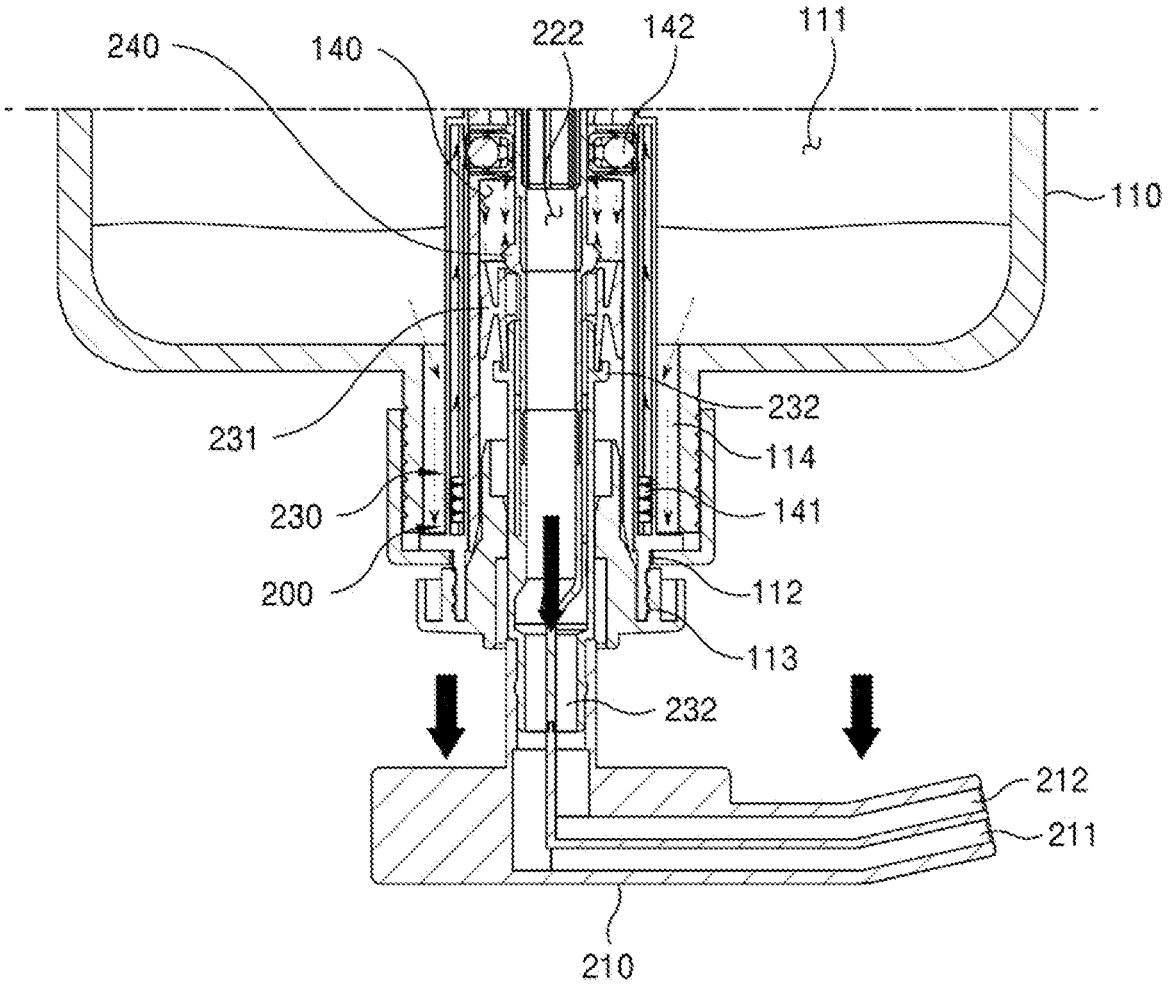
FIG. 8 and FIG. 9 are views illustrating that a liquid flows into the second chamber when the pump portion slides upward according to an embodiment of the present disclosure.
Figure 9:
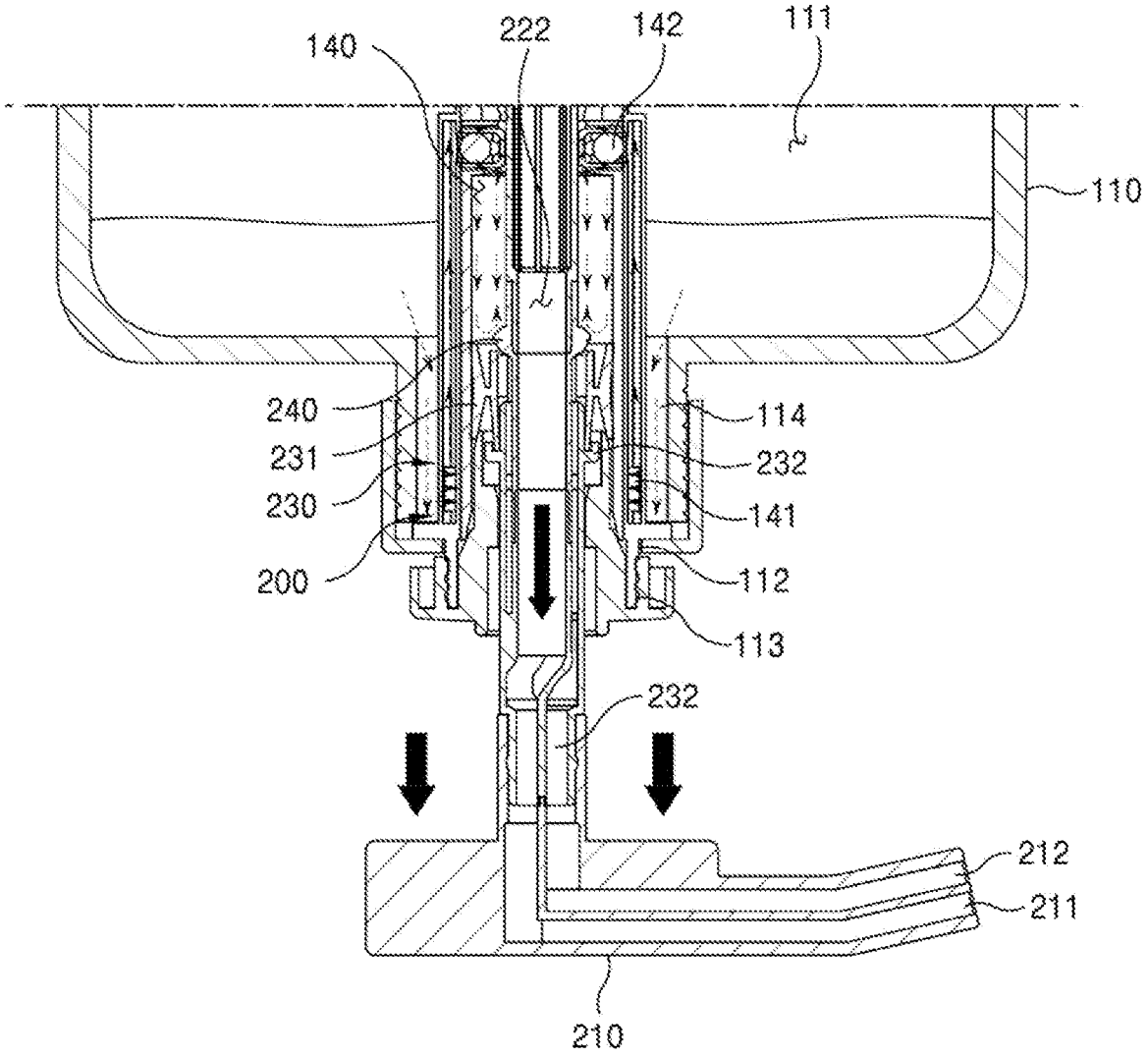

Referring to FIG. 8 and FIG. 9, when the user removes the force pressing the head portion 210, the pump portion 200 slides upward due to an elastic restoring force of the spring 160 provided in the lower portion of the pump portion 200, and the second piston 231 coupled to the pump portion 200 also slides upward.

As the second piston 231 slides upward, the space of the second chamber 140 is released and the second bearing 142 is lifted, and thus, the inlet of the second chamber 140 is opened.

A liquid stored in the inner space 111 of the vessel 110 passes through the connection flow path 114 provided on an upper surface of the vessel 110 due to a force by which the space of the second chamber 140 is released, and flows into the second chamber 140 through the suction portion 141.

Figure 10:
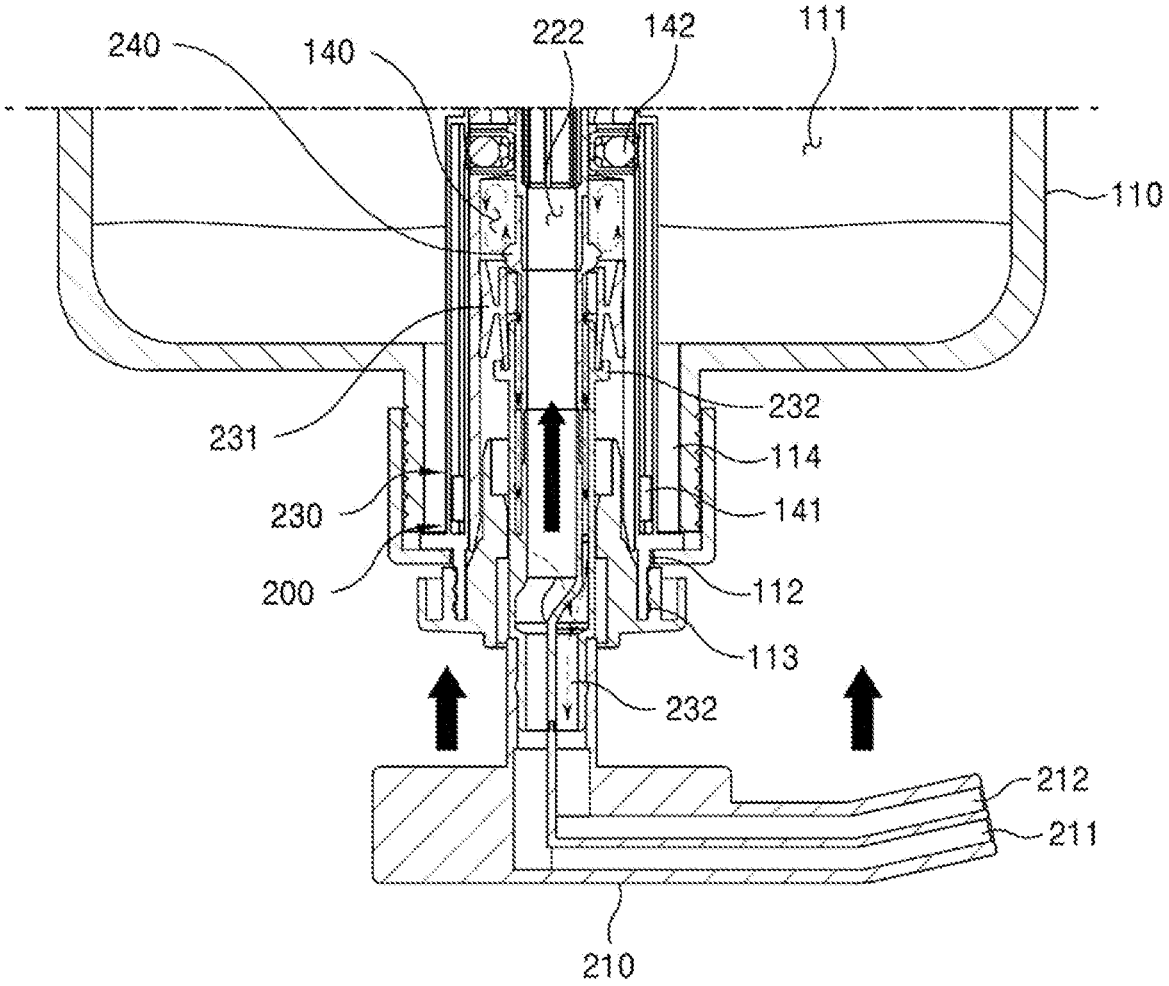
FIG. 10 and FIG. 11 are views illustrating that a liquid in the second chamber is discharged to the outside through a second discharge portion while the pump portion slides downward according to an embodiment of the present disclosure.
Figure 11:
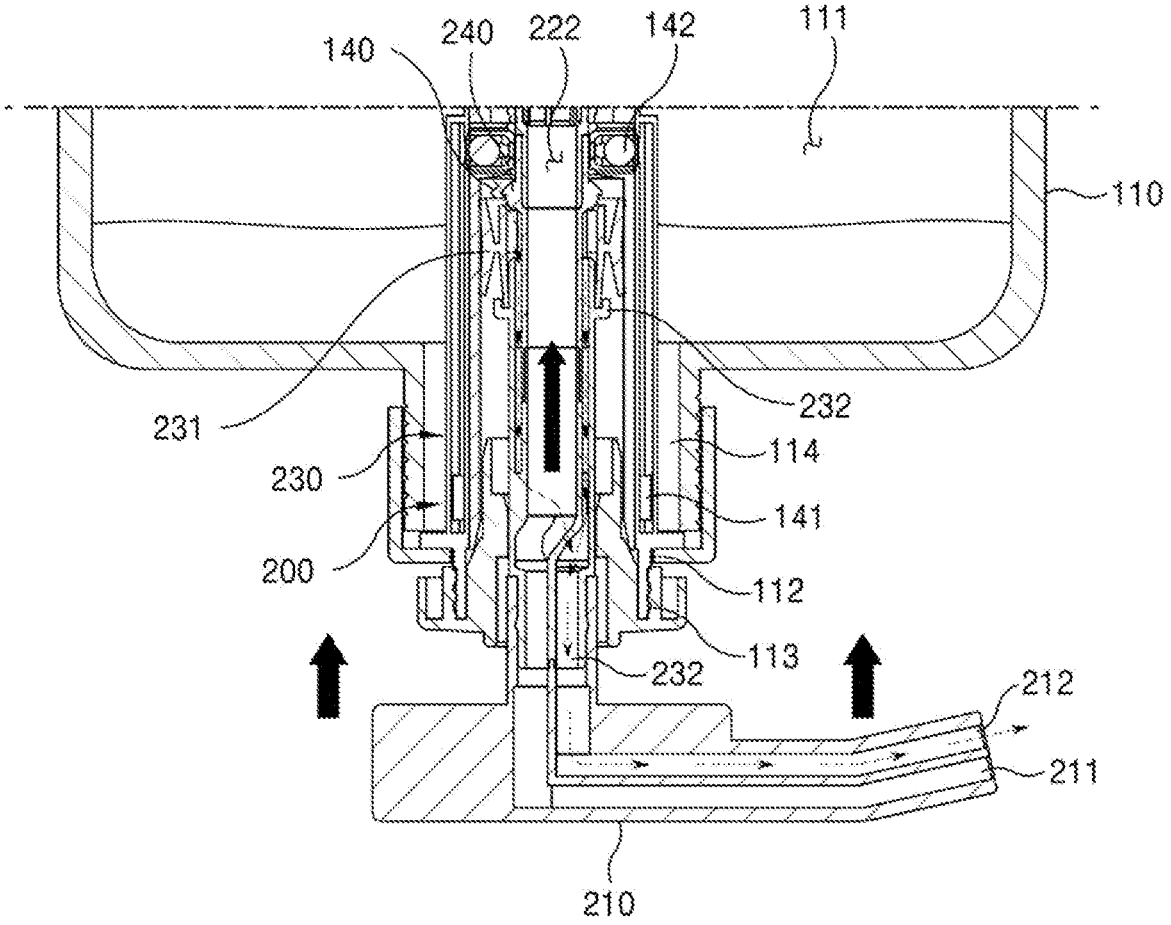

Referring to FIG. 10 and FIG. 11, when the user applies a force to the head portion 210 again, the pump portion 200 is pressed to cause the second piston 231 coupled to the pump portion 200 to slide to a lower portion of the second chamber 140, and thus, the second chamber 140 is compressed (at this time, the second bearing 142 blocks the inlet of the second chamber 140 again).

As the second chamber 140 is compressed, a liquid flowing into the second chamber 140 also receives a compressive force to move to the second movement flow path 232, and the liquid moved to the second movement flow path 232 is discharged to the outside along the second discharge portion 212. When the user removes the force pressing the head portion 210, the liquid in the vessel 110 flows into the second chamber 140 while the above-described processes are repeated.

The two-way pumping device for consumption of the residual amount of a liquid according to the embodiment of the present disclosure may discharge a liquid in the vessel 110 both when the vessel 110 is erected in the forward direction and when the vessel 110 is erected in the reverse direction through the above-described operating method.

When the vessel 110 arranged in the forward direction no longer discharges a liquid, a user arranges the vessel 110 in the reverse direction such that the residual amount of the liquid may be used.

An air discharge hole 133 may also be formed in an upper portion of the first chamber 130 of the two-way pumping device for consumption the residual amount of the liquid according to the embodiment of the present disclosure. As described above, the first chamber 130 and the second chamber 140 in the body portion 120 are partitioned by the partition portion 150.

Although the first chamber 130 and the second chamber 140 may be partitioned by the partitioning portion 150, there is a possibility that air may move from the first chamber 130 to the second chamber 140 due to a pressure of the first piston 221 that slides up and down in the first chamber 130.

When the air moves from the first chamber 130 to the second chamber 140, a liquid stored in the second chamber 140 may not be smoothly discharged to the second discharge portion 212, and thus, it is necessary to prevent the air from moving from the first chamber 130 to the second chamber 140.

In order to prevent this, the air discharge hole 133 is provided in the first chamber 130 to discharge air to the outside of the first chamber 130, and thereby, a pressure in the first chamber 130 may be reduced.

As air is discharged to the outside through the air discharge hole 133 while reducing a pressure of the first chamber 130, the air may be prevented from moving from the first chamber 130 to the second chamber 140.

The two-way pumping device for consumption of the residual amount of the liquid according to the embodiment of the present disclosure described above has the following effects.

The related art has a problem in that a liquid in a liquid vessel may not be completely discharged because a suction hose of a pumping device of the related art is spaced apart from a bottom of the liquid vessel without being in close contact with the bottom of the liquid vessel to easily discharge the liquid stored in the liquid vessel. The residual amount of a liquid on the bottom in a liquid vessel is quite large, and thus, it is uneconomical to discard the residual amount of the liquid without using it, and there is a problem in that environmental pollution occurs due to the residual amount of the liquid.

In order to use the residual amount of the liquid in the liquid vessel, the liquid vessel may be used by being turned upside down and opening a lid thereof, and in this case, the liquid is concentrated in an opening portion of the lid, and thus, much more liquid than necessary may be poured out at once.

However, the two-way pumping device for consumption of the residual amount of the liquid according to the embodiment of the present disclosure may discharge the liquid out of the vessel for storing the liquid both when the vessel is arranged in the forward direction and when the vessel is arranged in the reverse direction, and thus, there is an advantage in that the residual amount of the liquid may be fully consumed.

Particularly, the two-way pumping device for consumption of the residual amount of the liquid according to the embodiment of the present disclosure discharges the liquid in the order of a suction portion-a second chamber-a second movement flow path-a second discharge portion by using a pump portion, a second piston, and a second bearing when the vessel for storing the liquid is arranged in the reverse direction, and thus, there is an advantage in that the residual amount of the liquid may be easily used.

In addition, the two-way pumping device for consumption of the residual amount of the liquid according to the embodiment of the present disclosure fully consumes the liquid, and thus, there is an advantage in that a liquid may be used economically, and there is an effect that environmental pollution may be prevented from occurring because the residual amount of the liquid is prevented from being wasted.

As described above, the present disclosure is described in detail with reference to preferred embodiments, and the present disclosure is not limited to the above-described embodiments, and various modifications may be made without departing from the scope of the present disclosure. Accordingly, the true technical protection scope of the present disclosure should be defined by the technical idea of the appended claims.

What is claimed is:

1. A two-way pumping device for consumption of a residual amount of a liquid, the two-way pumping device being capable of discharging a liquid to an outside and comprising:

a vessel, having an inner space for storing a liquid and a coupling hole for communicating with the inner space; a body portion coupled to the coupling hole and including a first chamber and a second chamber for storing the liquid; a suction pipe configured to communicate with the first chamber and extending to an outside of the body portion; a first bearing provided between the first chamber and the suction pipe to open and close the suction pipe;

a pump portion, slidably coupled to the body portion and including a head portion protruding outside the body portion;

a first piston, coupled to the pump portion to slidably move together with the pump portion and configured to slidably move in the first chamber;

a second piston, coupled to the pump portion to slidably move together with the pump portion and configured to slidably move in the second chamber;

a spring, provided in a lower portion of the pump portion to apply an elastic restoring force to the pump portion;

a suction portion, for causing the liquid to flow into the second chamber;

a first discharge portion, provided in the head portion of the pump portion to communicate with the first chamber to discharge a fluid in the first chamber to the outside; and a second discharge portion, provided in the head portion of the pump portion to communicate with the second chamber to discharge a fluid in the second chamber to the outside, wherein when the vessel is arranged in a forward direction, the fluid in the first chamber is discharged through the first discharge portion, and when the vessel is arranged in a reverse direction, the fluid in the second chamber is discharged through the second discharge portion, wherein the body portion includes a partition portion that partitions the body portion into the first chamber and the second chamber, wherein an air discharge hole is provided in an upper portion of the first chamber.

2. The two-way pumping device of claim 1, further comprising:

a first movement flow path, provided in the pump portion and connecting the first chamber to the first discharge portion; and a second movement flow path, provided in the pump portion and connecting the second chamber to the second discharge portion.

3. The two-way pumping device of claim 1, wherein a connection flow path through which the suction portion communicates with the inner space is provided in an upper surface of the inner space of the vessel.

4. The two-way pumping device of claim 1, wherein a second bearing for opening and closing the second chamber is provided between the suction portion and the second chamber, and the second bearing closes a space between the suction portion and the second chamber when the pump portion descends, and opens the space between the suction portion and the second chamber when the pump portion ascends.

5. The two-way pumping device of claim 1, wherein the pump portion includes a first pump portion coupled to the first piston, and a second pump portion coupled to the second piston, and the first pump portion and the second pump portion are connected to each other through a connection portion.

* * * * *